United States Patent [19]

Corbett

[11] 4,203,542

[45] May 20, 1980

[54] CALCULATING APPARATUS

[75] Inventor: Clifford F. Corbett, Tipton, England

[73] Assignee: Foseco International Limited, Birmingham, England

[21] Appl. No.: 838,981

[22] Filed: Oct. 3, 1977

[30] Foreign Application Priority Data

Oct. 1, 1976 [GB] United Kingdom ..... 40895/76

[51] Int. Cl.[2] ..... G06C 3/00

[52] U.S. Cl. ..... 235/85 R; 235/61 B; 235/70 A; 235/89 R

[58] Field of Search ..... 235/61 B, 70 A, 85 R, 235/89 R

[56] References Cited

U.S. PATENT DOCUMENTS

| | | | |
|---|---|---|---|
| 666,091 | 1/1901 | Fergusson | 235/61 B |
| 1,520,105 | 12/1924 | Bicknell | 235/85 R |
| 1,667,812 | 5/1928 | Miller | 235/61 B |
| 3,436,012 | 4/1969 | Stephenson | 235/61 B |
| 3,533,551 | 10/1970 | Cole et al. | 235/89 R |
| 3,559,881 | 2/1971 | Maison | 235/61 B |
| 3,627,199 | 12/1971 | Hill | 235/85 R |

FOREIGN PATENT DOCUMENTS

| | | | |
|---|---|---|---|
| 647895 | 11/1964 | Belgium | 235/70 A |
| 2254112 | 11/1972 | Fed. Rep. of Germany | 235/70 A |

*Primary Examiner*—Stephen J. Tomsky

*Attorney, Agent, or Firm*—Cushman, Darby & Cushman

[57] ABSTRACT

A calculator is described which greatly simplifies the calculation of the required feeder head parameters, e.g. size, amount of antipiping compound, in casting metals. Only the size of the casting section being fed and the normalized inscribed circle relating thereto need to be measured.

1 Claim, 3 Drawing Figures

CALCULATING APPARATUS

This invention relates to calculating apparatus for use in molten metal casting, particularly for use in connection with the manufacture of steel castings.

When most metals solidify, the metal shrinks. If action is not taken to compensate for such shrinkage, shrinkage cavities form in cast metal. This is clearly undesirable in the case of metal castings since it adversely affects the strength and other properties thereof. It has accordingly been the practice for many years to provide extra molten metal to a casting which extra metal is so arranged that as the desired casting solidifies, from its outer surface inwards, molten metal is available to feed the interior of the desired casting.

The extra volume of molten metal is denoted a feeder head and in order to fulfil its intended function a feeder head must have two particular properties: first, it must not solidify before the casting which it is designed to feed has solidified. Second, it must contain sufficient molten metal to compensate for the shrinkage on solidification of the casting.

Even though the actual amount of metal required to constitute an appropriate feeder head for a given casting may be reduced by the use of insulating or exothermic casting risers, substantial quantities of metal are required for use in feeder heads, which quantities of metal have to be removed from the solidified casting and then remelted.

Remelting costs and the inevitable losses accompanying solidified feeder head removal make it ever more important from an economic and practical point of view to provide a feeder head which is big enough to guarantee proper feeding and sound casting but not so big as to contain excess metal.

Attempts have accordingly been made in recent years to develop systems whereby the appropriate sized feeder head for a particular casting may be determined. For a full discussion of these systems, attention is directed to R. Wlodawer, "Directional Solidification of Steel Castings" Pergamon Press 1966. In this volume, an approach to calculating the correct feeder head for a particular casting is given. This approach is based on the calculation of the "modulus" for the various parts of the casting. The modulus is simply the volume of the part of the casting under consideration divided by the cooling surface area of that part i.e. the area not in contact wih the remaining parts of the casting. Use of the "modulus method" gives satisfactory results in most cases though it tends to lead to overfeeding in the case of relatively compact or so-called "chunky" casting shapes and to underfeeding in the case of extended or so-called "rangy" casting shapes.

An alternative approach which is described in the book by Wlodawer referred to above is known as the Heuvers circle method. In this method, a notional series of circles is inscribed within the casting shape (corresponding to a notional series of spheres within the casting itself considered in three dimensions) and feeder heads are provided at those casting sections corresponding to the maximum size of the circles or spheres respectively. The size of the feeder necessary will depend upon the size of the maximum inscribed circle or sphere as well as on the surroundings of the feeder head, e.g. whether the feeder head is to be surrounded simply by bonded sand or by a heat insulating or exothermic riser sleeve.

In practice, even the Heuvers circle method is not always accurate in its prediction of the optimum riser size, and the practice has grown up among casting engineers using the method of drawing not the Heuvers circles but a circle of slightly greater size (which accordingly is no longer strictly "inscribed" in the casting section), the increase in size being to take into account the thermal effects of the particular features of the casting or casting section. Thus, the circle may be increased, e.g. by 10 to 20% in size, to allow for the effect of metal padding and of areas of the mould subject to superheat e.g. reentrant angles. There are no hard-and-fast rules as to what increase should be applied in any case, but it is part of the skill and experience of the casting engineer to judge this appropriately and accordingly to draw a "normalised inscribed circle", i.e. a circle which is larger than the Heuvers circle by the appropriate amount. Instead of thinking in terms of circles, analogously, the casting engineer may draw a "normalised inscribed sphere".

It will be seen that in practice the calculation of feeder head size requires substantial geometrical and arithmetical calculations to be undertaken and this is time-consuming. The skill of a casting engineer is well applied in deciding the various positions at which a casting should be fed, in deciding the sections into which the casting falls to be considered for the purpose of ensuring adequate feeding and in deciding the size of the normalised inscribed circle. However, it is uneconomic use of such a person's time to require that person to make all the necessary detailed calculations if it can be avoided. We have now discovered that if certain factors are fixed, e.g. the type of riser sleeve used to surround a feeder head, then it is possible to secure proper feeding but without the use of overlarge feeder heads over a very wide range of casting shapes and sizes by taking only two parameters into account, viz. the size of the casting or casting section to be fed and the size of the appropriate normalised incribed circle or sphere. By reducing the variables in this way to two, it is possible to produce calculating apparatus e.g. in nomogram or slide rule form which enables feeder head dimensions appropriate to the particular casting or section under consideration to be read off directly.

Such apparatus substantially facilitates the rapid and efficient construction of appropriate casting moulds and leads to economies both in respect of the amount of molten metal used in feeder heads and in respect of the technical time occupied in calculating proper feeder head dimensions.

According to a first feature of the present invention there is provided calculating apparatus comprising means having a first scale corresponding to the size of a casting or casting section to be fed with molten metal, means having a second scale corresponding to the diameter of the normalised inscribed sphere or circle (as defined above) associated with the casting or casting section to be fed and means having a third scale which is associated with the first and/or the second scale such that a feeder head parameter (as hereinafter defined), values of which are ranged along the third scale, may be read off therefrom, the particular value being dependent upon the association between three scales.

Such apparatus may take the form of a graph or nomogram but preferably takes the form of a slide rule or slide chart apparatus. According to a specifically preferred form of the present invention there is provided calculating apparatus comprising an apertured scale-bearing first member and a second scale-bearing member slidable relative to the first member and having two scales visible through apertures in the first member, one of which two scales lies adjacent the scale on the first member when the two members are assembled together, those two adjacent scales corresponding respectively to the size of a casting or casting section to be fed with molten metal and the diameter of the normalised inscribed sphere or circle for the casting or casting section to be fed and the remaining scale corresponding to a particular feeder head parameter.

By the term feeder head parameter we mean any parameter of a feeder head for a particular type of feeder head which may vary from one case to another. The most common feeder head parameter is its size which will vary dependent upon the size of the casting to be fed. Another feeder head parameter is, for example, the weight of antipiping powder which should be placed on the top of the riser after the casting mould has been filled with the molten metal.

A number of third scales may be provided on a single calculating apparatus each corresponding to a different feeder head parameter. For example, one third scale may give the appropriate size of exothermic riser sleeve of a particular type, another the size of a heat insulating riser sleeve of a particular type, another the quantity of antipiping powder necessary to place on top and another the size of a sand lined feeder head. Different third scales may be provided for different types of riser sleeve, e.g. domed riser sleeves, riser sleeves with a height to diameter ratio of 1 and riser sleeves with a height to diameter ratio of 1.5.

The scale corresponding to the size of the casting or casting section to be fed is preferably graduated in weight or in volume. The calculating apparatus, particularly when of slide rule type, may contain additional scales for converting feeder dimensions (e.g. for a cylindrical feeder) into the weight of metal in the feeder which must of course be added to the weight of the casting in order to calculate the total weight of the metal required to make the casting.

The scales of the apparatus may of course be graduated in any appropriate units, e.g. British Imperial Units or Metric Units. In the case of slide chart or sliderule type calculators the apparatus may be produced as a sleeve with a slide chart inside it, each side of the sleeve having windows and each side of the slide chart being printed with scales. One side may be calibrated in Imperial units and the other side in metric units.

It will be appreciated that the size of feeder head required depends not only on the geometry of the casting but also on the shrinkage on solidification of the molten metal used. Thus larger feeder heads will be needed for e.g. high manganese or high chromium steels than for plain carbon steel, which on average shrinks by only about 6% on solidification. Accordingly, the scales of apparatus according to the present invention will be applicable only to calculating casting parameters for metals having shrinkages within a certain range.

In the case of slide chart types of apparatus, two or more slides may be provided, each graduated differently, and each for use depending on the particular type of molten metal being cast.

In some cases, it may be convenient to provide more than one set of cooperating first scale and second scale, e.g. to enable the apparatus to be used over a very wide range of casting sizes while keeping the apparatus relatively compact. Thus, a first pair of scales could e.g. cover normalised inscribed circle diameters of up to 40 cm and casting or casting section weight of 2 to 1400 kg, while a second pair of scales covered normalised inscribed circle diameters of up to 120 cm and casting or casting section weights of 20 to 45,000 kg.

The present invention provides, in addition to calculating apparatus as set out above, a method of casting molten metal to form a desired casting which comprises notionally dividing the casting into sections each of which require to be individually fed, calculating the size (weight or volume) of each such section, determining the size of the normalised inscribed circle for each such section, calculating the feeder head parameter(s) for each such section using the apparatus described above, forming a mould corresponding in shape and size to the desired casting, forming on or in the mould a plurality of casting risers, each corresponding to one of the sections of the casting, and to the determined feeder head parameter(s) for that section, casting molten metal into the mould to fill the mould and the casting risers, and allowing the molten metal to solidify in the mould to form the desired casting.

The invention is illustrated by way of example in the accompanying drawings, in which.

Figure 1:
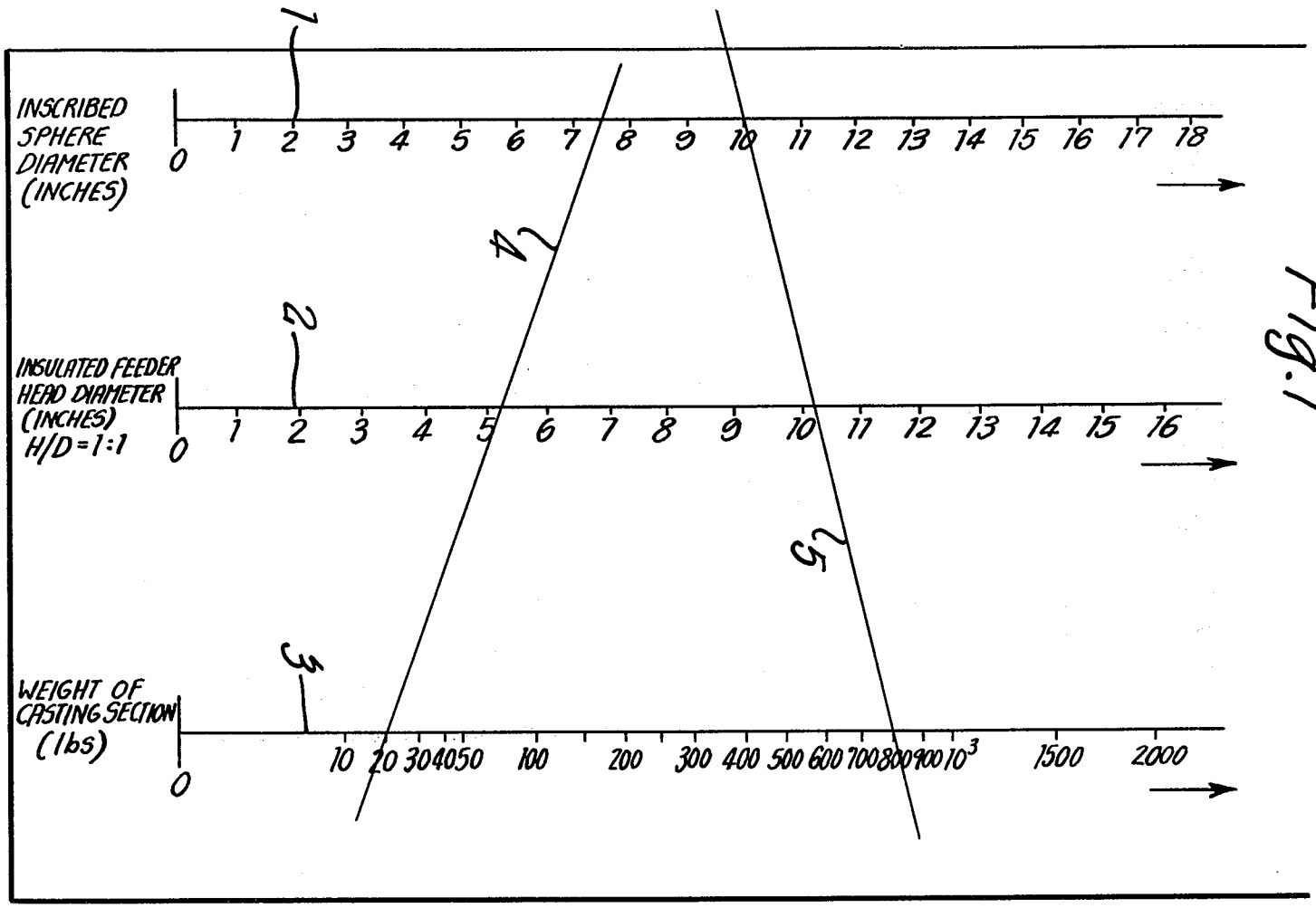
FIG. 1 is a nomogram for calculating riser sleeve diameter.

In both types of calculating apparatus shown in the drawings, the interrelationship of the scales is such as to produce correct results when working with metals of solidification shrinkage about 6%, i.e. with most normal cast steels.

Referring to the drawings, FIG. 1 shows a nomogram having three scales. Scale 1 corresponds to the normalised inscribed circle or sphere diameter, scale 2 corresponds to a desired riser sleeve diameter for the casting section and scale 3 to the weight of the casting or casting section in pounds. The nomogram is used in customary fashion by joining the points on scales 1 and 3 corresponding to the particular casting or casting section to be fed with a straight line and reading off the value from the intersection of that straight line with scale 2. Thus in a first example, a casting section has a normalised inscribed circle of diameter of 7½ inches and has a weight of 20 pounds. Straight line 4 indicated on FIG. 1 shows by its intersection with scale 2 that the correct riser sleeve dimension is 5 inches diameter by 5 inches height. This will be correct for a particular type of riser sleeve only. A plurality of scales 2 may be provided e.g. corresponding to different types of riser or differently proportioned riser sleeves, e.g. ones having a height to diameter ratio of 1.5. In the second example shown on FIG. 1, a casting having a normalised inscribed circle of 10 inches and an overall weight of 800 pounds requires a 10 inch diameter × 10 inch high insulating riser sleeve to ensure adequate feeding.

Figure 2:
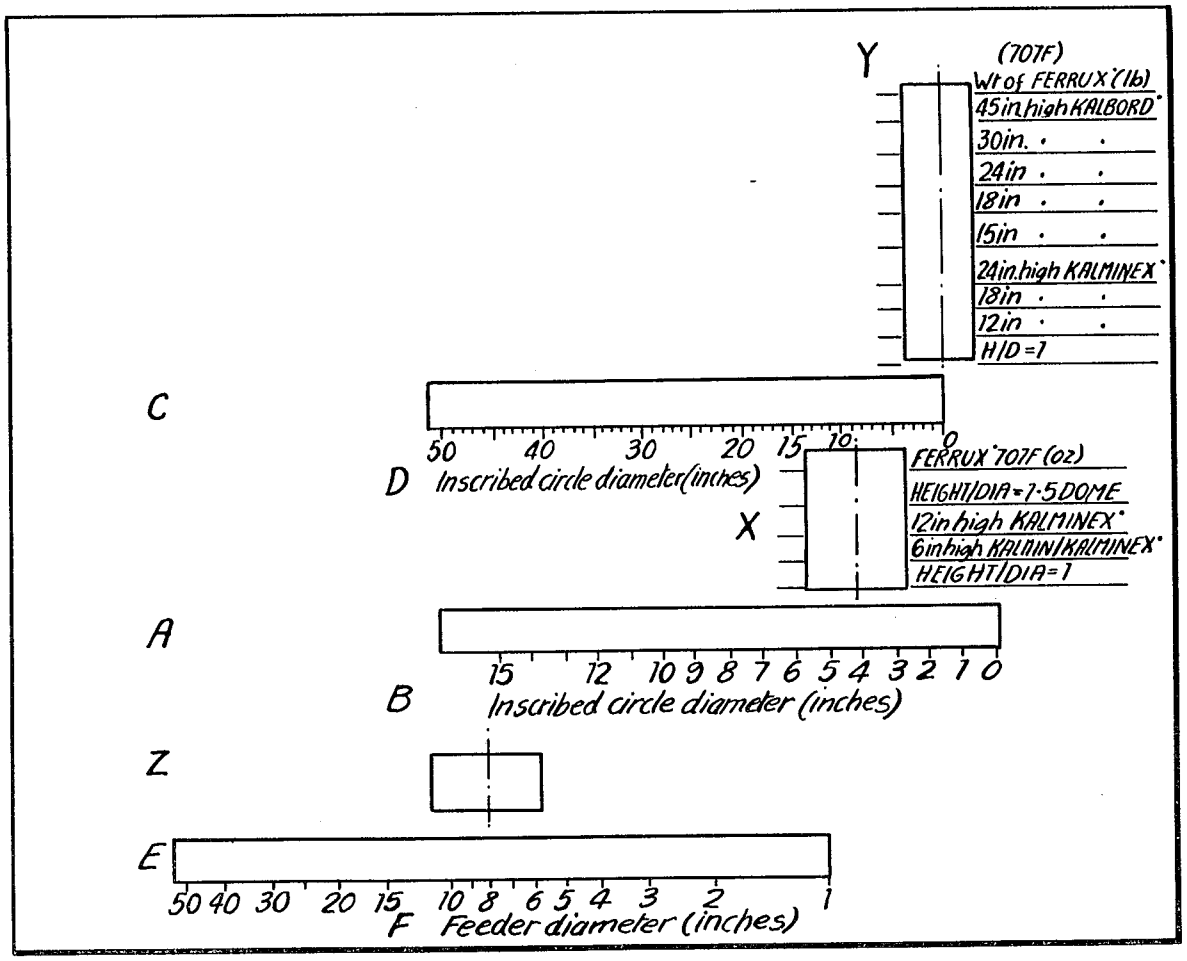
FIG. 2 is a view of the sleeve of a slide calculator according to the invention.
Figure 3:
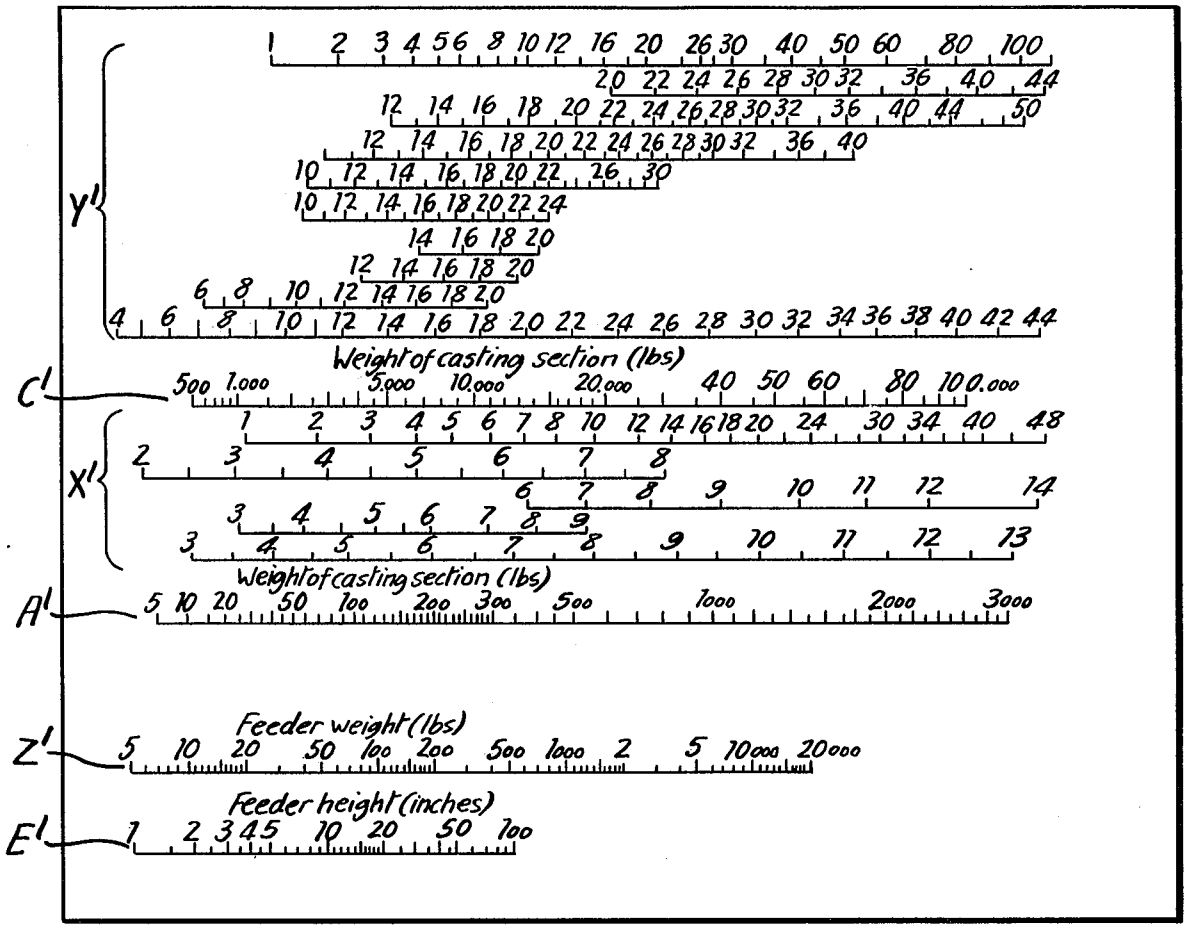
FIG. 3 is a view of the slide of the slide calculator according to the invention.

FIGS. 2 and 3 show the sleeve and slide respectively of a slide rule apparatus according to the present invention. This apparatus may be considered as notionally divided into three independently operative sections each consisting of a scale on the sleeve and two scales on the slide, the sleeve having a pair of windows, one adjacent the scale on the sleeve and the other over a scale on the slide. Each window may be provided with a reference line, indicated as chain lines in FIG. 2, to show the exact point of the underlying scale which should be read off.

Each of these three sections will now be described in turn: the first consists of a scale B on the sleeve adjacent a window A. When the slide is inserted into the sleeve scale A' shown in FIG. 3 underlies window A. At the same time, a plurality of scales X' underlie window X shown in FIG. 2. There are five scales X' and five levels indicated adjacent window X. As shown in FIG. 2 the uppermost line corresponds to the weight of proprietary antipiping compound (Ferrux 707F, Registered Trade Mark) which should be applied. The next line shows the size of a domed riser of height to diameter ratio 1.5 which should be employed, the next the diameter of a 12 inch high Kalminex (Registered Trade Mark) sleeve which could be used to line a riser, the next line the diameter of a 6 inch high Kalmin (Registered Trade Mark) or Kalminex sleeve which could be used to line a riser and the last line the size of a riser sleeve which should be employed of height to diameter ratio 1. If a casting section is for example of weight 500 pounds and of inscribed circle diameter 4½ inches, these two values are placed together by sliding the slide within the sleeve so that 500 on scale A' overlies 4½ on scale B. Casting parameters may then be read off through window X as follows:

10 ozs. of Ferrux 707F should be used either with a 7 inch 1.5 H/D ratio dome riser, a 7 inch diameter 12 inch high Kalminex riser sleeve, a 9 inch diameter 6 inch high Kalmin or Kalminex sleeve or an 8 inch diameter by 8 inches high such sleeve.

Referring now to the upper sections of the apparatus, scales D, C' and Y' correspond respectively to scales B, A' and X' just described and the mode of operation is the same. These scales are calibrated for larger castings and casting sections and accordingly window Y has 10 scales Y' lying thereunder corresponding to 10 casting parameters. The scales are used in the same way as just described. For example, if a casting section of weight 10,000 pounds and normalised inscribed circle diameter 30 inches is to be risered with a height to diameter ratio 1 Kalminex riser sleeve, the open molten metal surface being covered by Ferrux antipiping compound after molten metal has been poured into the mould, the sleeve should be chosen to have a diameter and height of 31 inches and 35 pounds of Ferrux 707F should be placed on the riser after the molten metal has been poured into the mould.

It is of course necessary to know how much metal to melt for any particular casting or series of castings and the amount of metal to be melted must naturally include not only the metal which will form the castings themselves but also the metal which will form the risers. Many risers are simply cylindrical in shape which allows the easy calculation of their size in terms of the amount of metal in them. Scales F, E' and Z' are provided on the calculating apparatus according to the present invention for this purpose. Scale E' is visible through window E shown in FIG. 2 and scale Z' through window Z which is spanned by a reference line. In order to determine the weight of metal in a feeder head of a given diameter and height, scales F and E' are slid relative to one another to bring the respective two values together and the feeder weight in pounds read off through window Z. Thus a feeder diameter of 10 inches and a height of 15 inches gives a feeder weight of around 130 pounds.

It will easily be seen that the use of a calculating apparatus according to the present invention, particularly of the type described with reference to FIGS. 2 and 3 of the accompanying drawings greatly facilitates the task of designing a feeding system for a casting mould. In particular, the complex calculations of the type referred to in the book by Wlodawer are wholly taken care of by the apparatus of the invention. In use the apparatus of the invention is less time consuming than arithmetical calculations. The apparatus also eliminates the possibility of simple mathematical errors occurring during the complex calculations which could lead to an insufficiently large riser being used with consequent flaw generation in the final casting or to the use of an oversized riser with consequent increased production costs. Particularly in the case of one-off large steel castings, any such mistake can be extremely expensive in that the casting has to be scrapped, the mould cannot be reused and the entire moulding, risering and casting process must be repeated.

I claim:

1. Calculating apparatus for use in casting molten metal comprising: a first, body, member; a second, slidable, member, horizontally slidable with respect to said first body member; a first, linear scale being formed on said first member, and having numerical indicia associated therewith corresponding to the diameter of the normalized inscribed circle associated with a casting section to be fed with molten metal, and word character indicia indicating that the scale is for the normalized inscribed circle; a horizontally elongated opening formed in said first member, and a vertically elongated opening formed in said first member; said first scale being disposed along said first horizontally elongated opening formed in said first member; a second, linear, scale having numerical indicia associated therewith corresponding to a feeder head parameter and word character indicia indicating the feeder head parameter, said second scale being formed on said second member; the numerical indicia of said first and second scales being in the same units, with the numerical indicia of the second scale spaced apart a distance greater than the numerical indicia of said first scale are spaced apart; a third, logarithmic, scale having numerical indicia associated therewith corresponding to the casting section weight or volume, and word character indicia indicating that the scale is for casting section weight or volume, said third scale being formed on said second member; said first, second, and third scales being disposed in physical proximity with each other so that they are correlated, the correlated numerical value associated with one of the scales being readily determinable if the numerical value associated with the other two scales is known; a plurality of indicia markings provided along said vertically elongated opening, each indicating a different feeder head parameter; said second and third scales being parallel on said second member, and said second scale positioned so that it is readable through said vertically elongated opening and is adjacent to an indicia marking of said vertically elongated opening indicating a feeder head parameter; a plurality of other scales on said second member parallel to the said second scale, and each cooperating with a said corresponding indicia marking provided along said vertically elongated opening; second and third horizontally elongated openings formed in said first member, and three additional scales corresponding to weight of metal in the feeder, feeder height, and feeder diameter, respectively, formed and positioned on said first and second members and associated with said second and third horizontally elongated openings, said second horizontally elongated opening having one of said feeder height and said feeder diameter scales formed therealong and the third of said horizontally elongated openings being centrally located with respect to, and vertically spaced from, said second horizontally elongated opening; and said scale corresponding to weight of metal in the feeder extending horizontally and being disposed on said second member so that it is visible through said third horizontally elongated opening, and said scale corresponding to the other of said feeder height and said feeder diameter extending horizontally and being disposed on said second member so that it is visible through said second of said horizontally elongated openings.

* * * * *